United States Patent [19]

Krause, Jr.

[11] Patent Number: 4,835,748

[45] Date of Patent: May 30, 1989

[54] ELECTRIC FIXTURE ADAPTER WITH PARALLEL SCREW THREADED SOCKETS

[76] Inventor: A. Frank Krause, Jr., P.O. Box 190, Fairfax, Va. 22030

[21] Appl. No.: 148,550

[22] Filed: Jan. 26, 1988

[51] Int. Cl.[4] ..... F21V 21/00

[52] U.S. Cl. ..... 362/249; 362/457; 439/643

[58] Field of Search ..... 362/249, 457; 434/641, 434/642, 643, 644, 645, 646, 647, 648, 649

[56] References Cited

U.S. PATENT DOCUMENTS

| | | | |
|---|---|---|---|
| 1,257,973 | 3/1918 | Bouchery | 439/643 X |
| 1,333,182 | 3/1920 | Minor et al. | 439/643 |
| 1,649,906 | 11/1927 | Mackenzie | 439/643 |
| 1,857,178 | 5/1932 | Benander | 439/643 |
| 1,875,270 | 8/1932 | Slade et al. | 439/643 |
| 1,936,423 | 11/1933 | Clemence | 439/643 |
| 2,117,608 | 5/1938 | Hertzberg | 439/643 |
| 2,675,444 | 4/1954 | Shapiro | 439/643 X |
| 2,689,945 | 9/1954 | Benander | 439/643 |
| 3,099,507 | 7/1963 | Tesmer | 439/643 |
| 4,616,299 | 10/1986 | Krause, Jr. | 362/255 |

FOREIGN PATENT DOCUMENTS

| | | | |
|---|---|---|---|
| 0041659 | 7/1925 | Norway | 439/643 |

*Primary Examiner*—Stephen F. Husar
*Assistant Examiner*—Richard R. Cole
*Attorney, Agent, or Firm*—Fleit, Jacobson, Cohn & Price

[57] ABSTRACT

An electric fixture adapter providing electrical energy to a pair of parallel cylindrical light bulbs which may be simulative of gas lights. The adapter includes a single screw threaded male element and a pair of spaced parallel screw threaded female sockets with electrical conductive members associated with the components in a manner to supply electrical energy to both of the light bulbs from the single male element.

2 Claims, 1 Drawing Sheet

ELECTRIC FIXTURE ADAPTER WITH PARALLEL SCREW THREADED SOCKETS

BACKGROUND OF THE INVENTION

Field of the Invention

The present invention generally relates to an electric fixture adapter and more particularly an adapter providing electrical energy to a pair of parallel cylindrical light bulbs which may be simulative of gas lights. The adapter includes a single screw threaded male element and a pair of spaced parallel screw threaded female sockets with electrical conductive members associated with the components in a manner to supply electrical energy to both of the light bulbs from the single male element.

INFORMATION DISCLOSURE STATEMENT

Adapters of Y-shaped configuration for supporting and providing electrical energy to a pair of spaced light bulbs screw threaded into a pair of diverging female sockets are commercially available with the diverging relation being necessary when considering that the light bulbs supported by the two diverging sockets are generally spherical in configuration. However, the prior art does not include an arrangement to support a plurality of elongated generally cylindrical light bulbs which simulate gas lights so that the simulated gas lights are supported in parallel spaced relation.

SUMMARY OF THE INVENTION

An object of the present invention is to provide an adapter for an electric fixture in the form of a body having a single screw threaded male element for screw threaded engagement with an electric fixture and a pair of screw threaded female sockets for supporting a pair of generally cylindrical light bulbs in spaced parallel relation and including a unique arrangement of conductive components to effectively supply electrical energy to a pair of generally cylindrical light bulbs from a single light fixture.

Another object of the invention is to provide an adapter in accordance with the preceding object in which the body is constructed of insulative material and provided with two identical components each forming one-half of the body and including conductive elements associated with the body and conductive screw threaded components forming the sockets in order to provide electrical energy to both of the female sockets from the single screw threaded male element with the structure being uniquely arranged and associated to provide a relatively inexpensive structure and one which can be easily assembled.

A further object of the invention is to provide an adapter in accordance with the preceding objects in which the conductive elements include a conductive strip having one end oriented in the bottom portion of a female socket and the other end forming a central portion of the screw threaded male element and a screw threaded conductive female socket having a conductive strip attached to the exterior periphery thereof and extending to and in electrical contact with a screw threaded conductive member on the screw threaded male element of the adapter.

These together with other objects and advantages which will become subsequently apparent reside in the details of construction and operation as more fully hereinafter described and claimed. reference being had to the accompanying drawings forming a part hereof, wherein like numerals refer to like parts throughout.

DESCRIPTION OF THE PREFERRED EMBODIMENT

Figure 3:
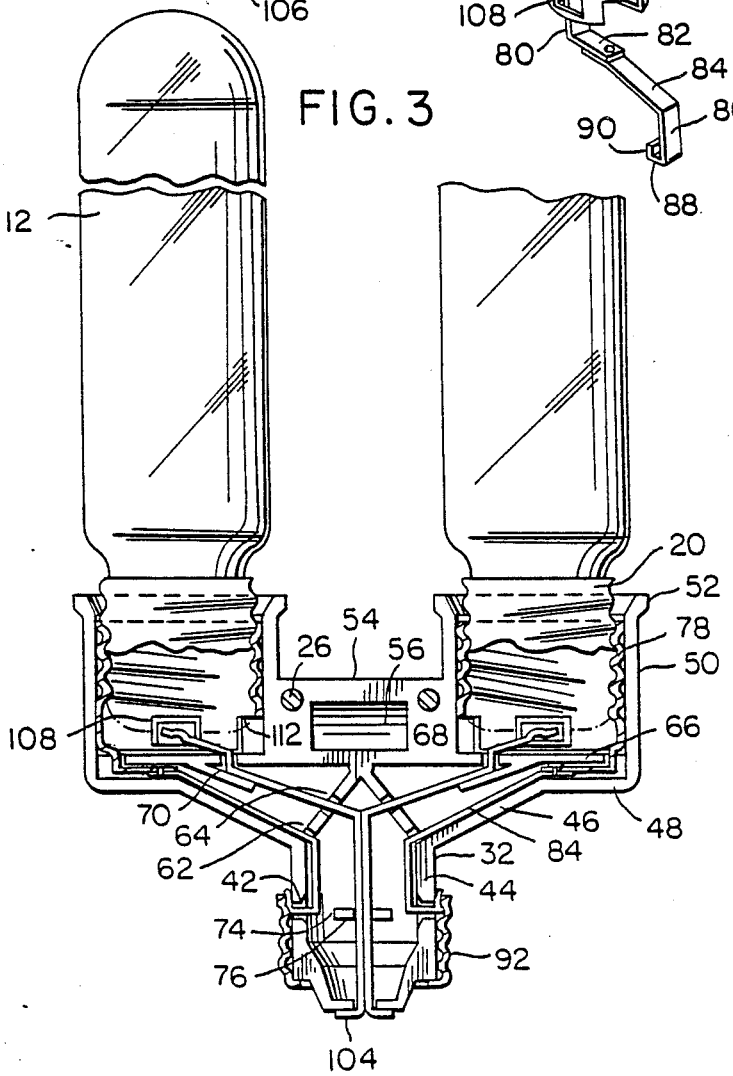
FIG. 3 is a vertical sectional view taken along section line 3—3 on FIG. 2 illustrating the structural details of the adapter.

Referring now specifically to the drawings, the adapter of the present invention is generally designated by reference numeral 10 and is utilized to support a pair of generally parallel, laterally spaced light bulbs or gas light simulatives 12 as shown in my U.S. Pat. No. 4,577,265. The adapter 10 has a screw threaded male element generally designated by the numeral 14 that is adapted to be screw threaded into a female socket on a light fixture or the like. The adapter 10 also includes a pair of internally threaded female sockets 16 and 18 which receive the screw threaded base 20 of the light bulbs 12 as illustrated in FIG. 3 thereby supporting the light bulbs 12 in parallel relation so that two light bulbs can be supported from a single light fixture with the light bulbs 12 being in spaced parallel relation.

Figure 4:
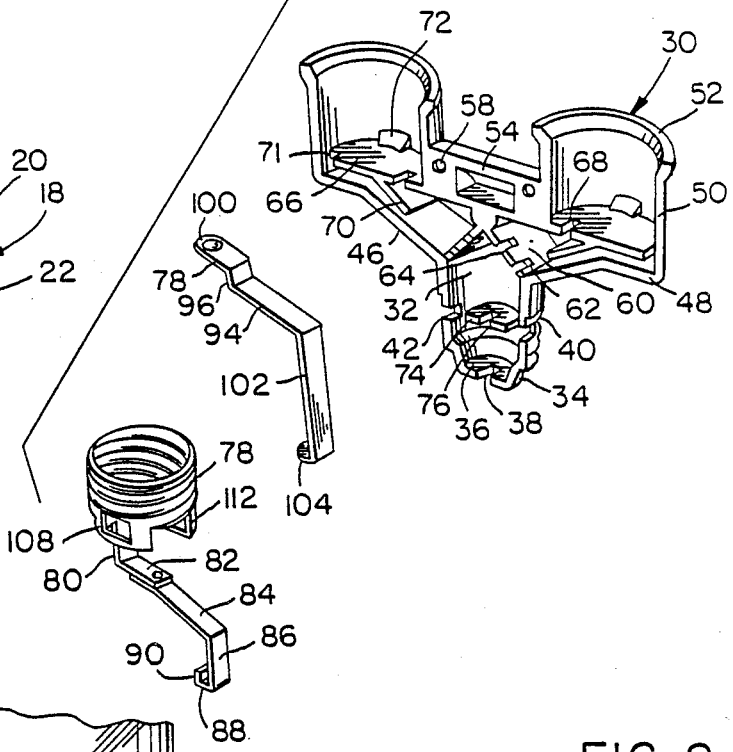
FIG. 4 is an exploded perspective view illustrating certain of the components forming the adapter of the present invention.

The adapter 10 includes a body generally designated by numeral 22 constructed of insulative material such as substantially rigid plastic or the like and the body 22 is separated into two identical halves by a line of separation 24 and the two halves formed by the line of separation 24 are secured together by screw threaded fasteners 26, rivets or other permanent fastening means since the device is not intended to be disassembled once it has been assembled into its final form. The body 22 thus includes a pair of halves designated by numerals 28 and 30 in FIG. 2 with the two halves being identical and with the half 30 being illustrated in FIG. 4.

As illustrated in the drawings, the structure of the body 22 includes the sockets 16 and 18 which are generally cylindrical in configuration and the male element 14 which is also generally cylindrical in configuration. The body half 30 includes a semi-cylindrical wall 32 which tapers inwardly at its lower end at 34 and terminates in a flat bottom 36 having a lateral notch 38 therein. The external surface of the semi-cylindrical wall 32 is provided with external threads 40. Also, the edges of the semi-cylindrical wall 32 are provided with notches 42 which are relatively shallow. The portion of the threaded end of the semi-cylindrical wall 32 adjacent the notched edge is flattened as at 44 on the external surface thereof. Extending from the upper end of the wall 32 are outwardly and upwardly inclined bottom wall portions 46 terminating in horizontal wall portions 48 which are integral with a semi-cylindrical vertical wall 50 terminating at its upper edge in an outwardly flared portion 52. The two semi-cylindrical portions 50 are interconnected by a vertical wall 54 having the central portion thereof hollowed out as at 56 and provided with apertures 58 receiving the fasteners 26. Also extending upwardly and inwardly from the upper end of the semi-cylindrical wall 32 is a pair of walls 60 each of which is provided with a pair of notches 62 and 64 therein. Extending horizontally from the bottom of the semi-cylindrical wall 50 and spaced above the wall portion 48 is a bottom wall 66 that extends inwardly and forms a bottom for the vertical wall 54 and is integral with the walls 60. The inner edge of the wall 66 is provided with a notch 68 and just outwardly of notch 68 and extending downwardly and inwardly from the wall 66 is a partial inclined wall 70 and the outer edge of the wall 66 includes a notch 71. All of the structure is of one piece construction molded in a conventional manner. The inner surface of the semi-cylindrical wall 50 is provided with a wedge-shaped projection 72 and the central portion of the semi-cylindrical wall 32 is provided with a projecting lug 74 having an edge notch 76 therein for a purpose described hereinafter.

Positioned in each socket 16 and 18 is a threaded conductive member 78 that includes a downwardly extending conductive strip 80 integral therewith as well as a laterally extending strip portion 82 connected to a downwardly inclined strip portion 84 terminating in a vertical strip portion 86 having a laterally outwardly extending flange 88 at its lower end which terminates in an upturned flange 90. The conductive female member 78 is positioned in the semi-cylindrical wall portions 50 of the body halves 28 and 30 with the strip 80 extending through the notches 71 and strip portion 82 extending under the bottom wall 66 with the strip 80 extending upwardly along the outer edge of the bottom 66 and inwardly of the wall 50 as illustrated in FIG. 3. The strip portion 84 is received in the notch 62 and the strip portion 86 extends downwardly along the inner surface of the semi-cylindrical wall 32 with the outwardly extending flange 88 extending out through the notch 42 and the terminal end flange 90 being engaged by a screw threaded conductive male member 92 threaded onto the external surface of the semi-cylindrical walls 32 which form the male member 14 thereby providing electrical continuity between the screw threaded conductive member 92 and the screw threaded conductive member 78.

Figure 1:
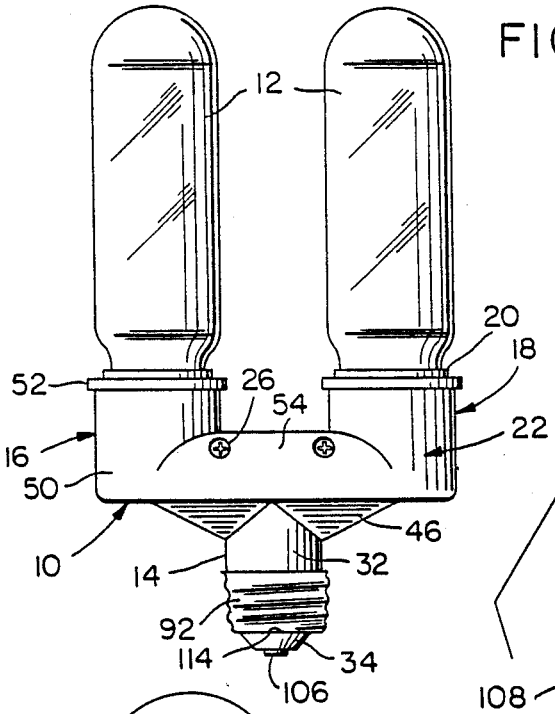
FIG. 1 is an elevational view of the adapter of the present invention illustrating a pair of cylindrical light bulbs supported thereby.
Figure 2:
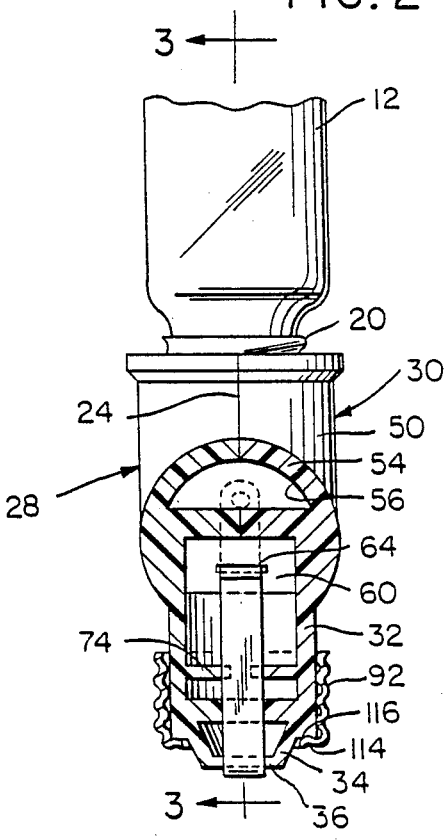
FIG. 2 is a vertical sectional view through the center of the adapter.

Each socket 16 and 18 also includes an inclined conductive strip 94 which is oriented in the notch 64 and includes an upwardly extending portion 96 extending through the notch 68 and terminates in an inclined strip 98 provided with a spherical projection of contact member 100 oriented centrally above the surface of the bottom wall 66. The strip 94 also includes a vertical portion 102 and a laterally outwardly extending flange 104 at its lower end. The vertical portion 102 extends through the notch 76 in the projecting lug 74 and extends through the notch 38 in the base or bottom wall 36 with the outwardly extending flange 104 cooperating with a similar flange on the strip in the other socket to form a central contact member 106 at the lower end of the male member 100 as illustrated in FIG. 1 with the conductive strips 94 providing electrical continuity between the center interior of the female sockets 16 and 18 and the center bottom of the male element 14. The opposed side walls of the screw threaded conductive female member 78 includes apertures 108 which receive the wedge-shaped projections 72 with the projections serving to fixedly retain the screw threaded conductive female member 78 in place. The bottom of the female member 78 includes inwardly extending flange portions 110 which rest against the surface of wall 66 but are spaced from the contact strip portion 98 so there is no electrical contact therewith. Also, the wall of the female member 78 where it overlies the conductive strip 94 is provided with a cut-out notch 112 thereby eliminating any possible contact between the member 78 and the strip 98. The conductive strip 94 is constructed of spring metal and the notch 68 is slightly wider than the thickness of the portion 96 of the strip 94 extending therethrough so the contact element 100 can flex downwardly by bending the strip 94 along its contact with the notch 64 in the wall 60. This enables the contact member 100 to engage the center of the screw threaded base 20 on the light bulb 12 and its resiliency enables the light bulb to be tightened into electrical contact with the contact member 100 on strip 98 with the exterior of the screw threaded base 20 being in electrical contact with the screw threaded conductive female member 78. The two strips 94 cooperate to form the center contact 106 for the male screw threaded element 14 and the metal conductive screw threaded conductive member 92 on the male element 14 is in electrical contact with both of the upwardly extending flanges 90 on the two screw threaded conductive female members 78 as illustrated in FIG. 3 thereby providing electrical continuity between the screw threaded conductive member 92 and the two screw threaded conductive female members 78. When assembled, the screw threaded member 92 is screw threaded onto the threads 40 on the base and indentations 114 are then formed in the bottom flange of the screw threaded member 92 to lock the screw threaded member 92 in place with the bottom flange of the semi-cylindrical wall 32 including a recess 116 receiving the upward off-set indentation 114 as illustrated in FIG. 2 thereby facilitating the assembly and permanent orientation of these components. All of the components of the adapter are easily constructed utilizing conventional structural techniques with the body halves 28 and 30 being molded from rigid plastic material or other insulating material and the conductive screw threaded members 78 and 92 and the conductive strips all can be constructed of well-known materials using well-known techniques in metal forming and the components are easily assembled and secured permanently in assembled relation by fasteners 26 and by the tubular screw threaded member 92 being anchored to the male member 14 by the indentations 114 being deformed into the recesses 116 thereby providing a relatively simple but yet dependable, long-lasting and effective adapter to electrically connect two light bulbs 12 with a single light fixture having a female internally threaded socket incorporated therein.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An electric fixture adapter comprising a body having a single externally threaded male element for screw threaded insertion into an internally threaded female socket on an electric fixture, a pair of internally screw threaded female sockets, oriented in spaced parallel relation and spaced from the male element for receiving the screw base of a pair of generally cylindrical light bulbs oriented in parallel closely spaced relation and conductive means electrically connecting the male element with the female sockets for supplying electrical energy to the light bulbs mounted in the female sockets, said body being constructed of rigid insulative material and including an internally threaded, generally cylindrical conductive member in each female socket, a single generally cylindrical screw threaded conductive member oriented externally of the male element, said conductive means including conductive strips connecting the periphery of the conductive members in the sockets with the periphery of the conductive member on the exterior of the male element, said conductive means also including conductive strips located centrally of the female sockets and extending through the male element and located centrally of the exterior end portion of the male element for engaging central contact members on the light bulbs and a central contact member on the female socket in the electric fixture, said body being formed of two halves of identical construction and being symmetrical on both sides of a line of separation between the two halves, fastening means securing the two halves together, said screw threaded conductive member being threaded on the exterior of the male element also serving to secure the two body halves together and means anchoring the threaded conductive member to the exterior of the male element to retain these components in assembled relation after initial assembly, each body half including a generally semi-cylindrical wall forming the male element when joined with an identical semi-cylindrical wall on the other body half, an end wall joined with the semicylindrical wall with each side edge of the semi-cylindrical wall including a lateral notch and the edge of the end wall including a lateral notch for receiving said conductive strips, each body half including a pair of semi-cylindrical walls forming the female sockets when joined with identical semi-cylindrical walls on the other body half, an inner end wall integrally joining the semi-cylindrical walls forming the sockets and the semicylindrical wall forming the male element, the inner end of the semi-cylindrical wall forming the male element including a pair of longitudinally and inwardly inclined walls with each inclined wall including a pair of spaced edge notches receiving the conductive strips and maintaining them in spaced relation, the end wall of each semi-cylindrical wall forming the female sockets including an end member spaced inwardly from the end wall with the end member including radially inner and outer notches receiving the conductive strips with the outer notch receiving a conductive strip connected with the screw threaded conductive member forming the female socket and the inner notch receiving a conductive strip having a central contact member thereon for engagement with a central contact member on the base of the light bulb with the central contact member in the female socket being inclined and resilient with the inner notch being slightly wider than the thickness of the conductive strip and the notch in the inclined wall gripping the conductive strip to enable resilient flexure of the conductive strip above the inclined wall as the conductive strip moves in the inner notch in the end member of the female socket.

2. Th structure as defined in claim 1 wherein said conductive strip connected to the screw threaded conductive member in the female socket extends through one of the notches in the inclined wall and through the notches in the side edges of the semi-cylindrical wall forming the male element into electrical contact with the screw threaded conductive member on the male element thereby providing electrical continuity between the single male element and the two female sockets on the body.

* * * * *